United States Patent [19]

Helmstadter

[11] 4,007,554

[45] Feb. 15, 1977

[54] ADJUSTABLE GUN SUPPORT

[76] Inventor: Glenn D. Helmstadter, 381 Niagara Drive, North Huntingdon, Pa. 15642

[22] Filed: May 5, 1975

[21] Appl. No.: 574,350

[52] U.S. Cl. ..... 42/94

[51] Int. Cl.[2] ..... F41C 29/00

[58] Field of Search ..... 42/94; 89/37 BA

[56] References Cited

UNITED STATES PATENTS

| | | | |
|---|---|---|---|
| 879,052 | 2/1908 | Jeranek | 42/94 |
| 2,290,545 | 7/1942 | Doering | 42/94 |
| 2,427,365 | 9/1947 | Meister | 89/37 BA |
| 2,870,683 | 1/1959 | Wilson | 42/94 |
| 3,156,062 | 11/1964 | Stevenson et al. | 42/94 |
| 3,225,656 | 12/1965 | Flaherty et al. | 42/94 |
| 3,576,084 | 4/1971 | Anderson, Jr. | 42/94 |

FOREIGN PATENTS OR APPLICATIONS

| | | | |
|---|---|---|---|
| 195,268 | 2/1908 | Germany | 42/94 |

*Primary Examiner*—Charles T. Jordan
*Attorney, Agent, or Firm*—John B. Sotak

[57] ABSTRACT

This disclosure relates to a versatile lightweight rifle rest having a pointed upstanding rod member and a step-on member for affixation to the ground and having an adjustable two-point contact cradle member for supporting the entire rifle and being readily positive positioned along the length of the upright rod member and being quickly and easily angularly rotated and elevationally pivoted to effectively sight in the rifle on a target.

10 Claims, 3 Drawing Figures

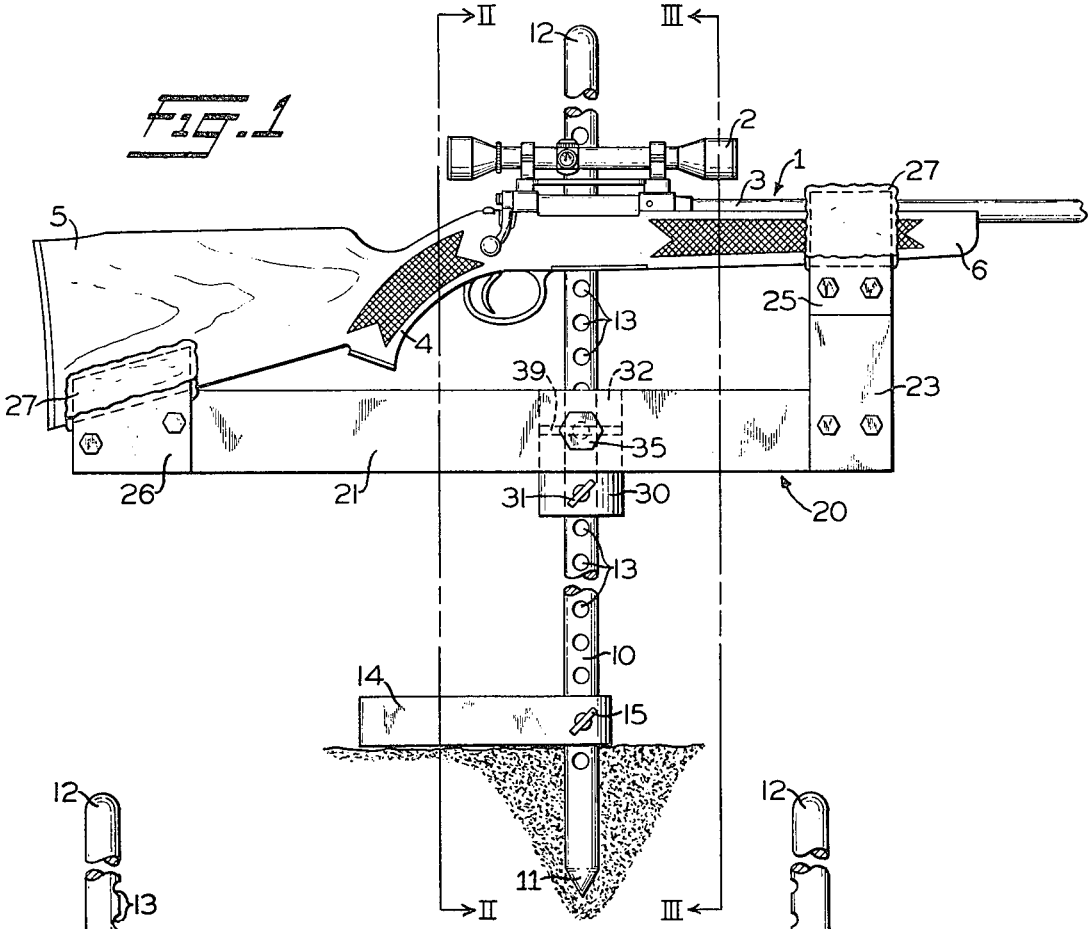
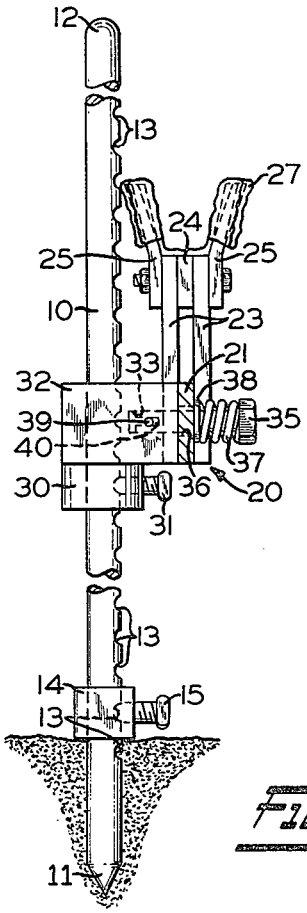
FIG. 2
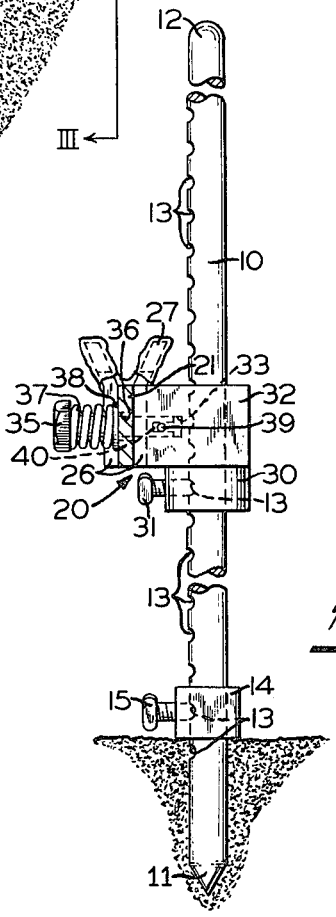
FIG. 3

ADJUSTABLE GUN SUPPORT

SUBJECT OF THE INVENTION

This invention relates to an improved highly-stable universally-movable gun support and more particularly to a unique adjustable rifle rest employing a unipod having a sharpened end and a step-on member for driving it into the ground and having an adjustable two-point supporting cross-piece member for carrying the entire weight of the rifle and for readily permitting vertical positioning as well as rotational and elevational manipulation of the rifle.

BACKGROUND OF THE INVENTION

It is the consensus of opinion of many experienced hunters and expert riflemen that the human factor is one of the most influential elements which adversely affects the shooting ability of amateur or seasoned sportsmen. That is, the human body which is composed of a great many movable joints and flexible muscles does not lend itself to the steadiness that is normally required for unerring and accurate shooting of a gun or rifle. The least amount of movement or flexure can materially affect the shooting accuracy that is necessary for achieving success in target shooting or game hunting. For example, in varmint hunting it is common practice to avoid as much of the human factor as possible by employing a gun rest or rifle support to obtain a greater degree of accuracy. Likewise, in long range target shooting and also in sighting-in rifles, it is advantageous to utilize a gun rest to obtain the most favorable or best results. In order to achieve the highest degree of accuracy, it is important to avoid as much human intervention as possible during the actual shooting of the rifle. In addition, the gun rest should provide the sole stable support for the rifle without the help of the shooter so that he may freely search out game with his binoculars or alternatively, he may readily check the target hits with his spotting scope. An appropriate gun support should also be capable of providing a multitude of vertical positions so that the rifleman may selectively fire from a kneeling, sitting or prone position. In addition, an acceptable gun support rest should allow for a full range of coverage both in a horizontal as well as an elevational direction so that the rifle may be freely manipulated to follow a moving animal or target or may be easily adjusted to zero-in on a stationary animal or fixed target. Additionally, the gun rest should be capable of withstanding the most adverse climatic conditions, such as, wind, cold, rain, sleet, hail and snow, which may be encountered during outdoor shooting and hunting trips. Further, the gun rest should be rugged, lightweight and portable since the trek through fields, forests and mountains can be a long and arduous journey. In addition to rigidly holding the rifle in situs, the gun support should allow easy placement of the rifle while preventing scratching and marring of the wooden stock and metallic barreled action of the rifle along with the attached scope.

OBJECTS AND SUMMARY OF THE INVENTION

Accordingly, it is an object of this invention to provide a new and improved gun support which independently and firmly holds a gun for increasing the shooting accuracy of a sportsman.

Another object of this invention is to provide a unique adjustable two-point contact rifle rest which may be quickly and easily driven into the ground for supporting a rifle.

A further object of this invention is to provide a novel stable gun rest having a pointed unipod and a step-on member for ground affixation and having a two-point contact cross-piece member for holding a gun steady for a shooter.

Still another object of this invention is to provide an adjustable rifle rest having a vertical ground piercing rod member and a horizontal rifle support member which is movable along the length of the vertical rod member and which is angularly rotatable and elevationally pivotable to permit a rifleman to facilely line up a target.

Still a further object of this invention is to provide a unique gun rest which is rugged, lightweight and portable for easy carrying and is quickly adjustable to the desired shooting position.

Yet another object of this invention is to provide an improved rifle support including a step-on member to drive a pointed vertical shaft into the ground and also including a universally adjustable cradle member for supporting a rifle.

Yet a further object of this invention is to provide a highly stable rifle rest which provides the sole support for a rifle yet affords a shooter a wide margin of adjustment and manipulation to permit the shooter to quickly and easily sight in on a target.

An additional object of this invention is to provide a new and improved gun support which is economical in cost, simple in construction, dependable in service, durable in use and efficient in operation.

In the attainment of the foregoing objects, there is provided a highly reliable gun support or rifle rest having an elongated metallic unipod member which is pointed at one end. A step-on metallic plate member is located at the lower end of the metallic unipod member for driving the pointed end into the ground. A two-point contact cradle member including an apertured block member freely fits onto the elongated metallic unipod member. A ring member also fits onto the elongated metallic unipod member and coacts with the cradle member to vary the height thereof. The elongated metallic unipod member includes a series of indentations situated along its length to provide a positive lock stop for the ring member and the step-on plate member, each of which is provided with a thread fastening screw. The cradle member includes an elongated metallic body member which is pivotally connected to the apertured block member by an adjustable thread bolt which is encompassed by a helical spring to provide frictional drag between the metallic body member and the block member. The cradle member includes a forward upstanding yoke member and a rearward upstanding yoke member located at the respective ends of the elongated body member. The metallic yoke members are covered by soft material which protects the rifle finish from being marred or scratched. The butt portion of the rifle sits into the rearward yoke while the forearm portion of the rifle fits into the forward yoke. The two-point contact allows the rifle to sit steadily on the cradle member without the aid or assistance of the shooter. The pivotal connection and apertured block allow the shooter to freely change the elevation and angular position of the cradle member and in turn, to adjust the rifle to quickly and easily sight-in a target.

Other advantages and more specific objects of the present invention will become more readily apparent from the following detailed description of the preferred embodiment described with reference to the accompanying drawings which form a part of this specification, in which:

FIG. 1 is a side elevational view of a gun support embodying the present invention in an operative upright condition showing a scoped rifle in its shooting position.

FIG. 2 is a frontal cross-sectional view taken along lines II—II of FIG. 1, with the rifle omitted.

FIG. 3 is a rearward cross-sectional view taken along the lines III—III with the rifle again omitted.

Referring now to the drawings and in particular to FIG. 1, there is shown a gun support or rifle rest in accordance with the present invention having a rifle 1 mounted thereon. In varmint hunting and target shooting, the rifle is generally equipped with a scope 2 to attain maximum spotting and to achieve greater accuracy. The rifle 1 includes a barrelled action 3 and a wooden stock 4 having a butt portion 5 and a forearm position 6. As shown, the gun rest provides a stable two-point contact support with one contact point at the butt 5 and with the other contact point at the forearm 6 of the rifle 1.

It will be noted that the rifle support or rest includes a single standard or vertical unipod member 10. The unipod member 10 is preferably constructed of a metallic rod, such as, stainless steel, aluminum or the like, so that the corrosive or adverse effects of inclement weather are minimized. As shown, the lower end 11 of rod 10 is pointed to facilitate affixation of the gun support as will be described in greater detail hereinafter. Conversely, the upper end 12 of the unipod or rod 10 may be smoothened or rounded to permit one to safely grip the top of the standard during affixation and removal. It will be noted that the metallic rod member 10 is provided with a plurality or series of indentations or holes 13 located along the length thereof. These indentations are utilized to provide positive lock stops for a step-on member and a ring member as will be described presently.

As shown, a metallic step-on member 14 is normally situated near the lower pointed extremity of rod 10. The step-on member 14 takes the form of a substantially thick aluminum or stainless steel plate which extends laterally with respect to the axis of rod 10. The plate member 14 includes a threaded hole for accommodating a suitable fastener, such as, thumb screw 15. It will be appreciated that the step-on member 14 may be raised or lowered to permit deeper or shallower penetration depending upon the composition and condition of the soil. The step-on member is held and locked in the selected position by tightening thumb screw 15 so that its inner tip fits snugly and firmly in one of the lower indentations 13. After the step-on member 14 is securely attached, the pointed end 11 may be depressed and driven into the ground by the shooter or hunter. That is, the rifleman simply places his foot onto the step-on member 14 so that the force of his weight pushes the rod 10 into the ground until the undersurface of the plate 14 engages and bears against the top surface of the ground. This surface bearing contact increases the stability of the entire gun rest.

In viewing FIGS. 1, 2 and 3, it will be seen that the rifle 1 rests in a metallic cross-piece or cradle member generally characterized by numeral 20. The cradle member 20 includes an elongated rectangular aluminum bar member 21 which is shown in the drawing as being positioned horizontal to the surface of the ground. In viewing FIGS. 1 and 2 it will be noted that the one or forward end of the bar 21 includes a pair of relatively short upstanding aluminum bars 23 which are secured at their lower end to the frontal extremity of the bar member 21 by suitable bolts and nuts (not characterized). The upper end of bars 23 accommodate an aluminum spacer block 24 and a pair of diverging aluminum plate elements 25 which form a V-shaped or yoke member. The parts of the frontal yoke member are secured to the upper end of bars 23 by suitable fasteners such as, bolts and nuts (not characterized). In viewing FIGS. 1 and 3, it will be noted that the other or rearward end of the elongated horizontal bar 21 also includes a V-shaped or yoke member formed by a pair of diverging plate elements 26 which are bolted or otherwise secure to the rearward extremity of bar 21. The yokes are preferably covered by suitable soft material, such as, rawhide covers 27, to protect the wood stock and metallic parts of the rifle 1 from being marred and scratched during placement and manipulation by the shooter. The cradle member 20 is universally movable in that it may be vertically shifted, angularly rotated and elevationally manipulated. As shown in FIGS. 1, 2 and 3, an aluminum ring member 30 is fitted onto the unipod 10 and is selectively moved to the desired height. The ring 30 includes a threaded hole which accommodates a suitable fastener such as, a thumb screw 31. The inner end of the thumb screw 31 cooperates with one of the indentations 13 to positively lock the ring 30 in position when the screw 31 is hand tightened. As shown, the upper surface of the ring 30 cooperates and communicates with the lower surface of apertured rectangular or box-like aluminum block member 32. The block member 32 is fitted onto the rod 10, and one flat vertical side of the block 32 is provided with a suitable threaded aperture 33. A pivot bolt 35 passes through a hole 36 provided in the bar member 21 located intermediate the ends thereof. A helical compression spring 37 is situated between the head of the bolt 35 and a bearing washer 38 while the thread end of the bolt 35 is screwed into the threaded hole 33. The compression spring 37 is utilized to increase or decrease the frictional resistance between the contacting surfaces of the bar 21 and block 32. When the appropriate frictional surface contact is obtained, the bolt may be locked in position by a metallic dowel pin 39 which passes through suitable slot or narrow opening 40 in the bolt 35 and the two aligned holes in block 32. It will be appreciated that the tension of the spring and the frictional drag may be adjusted by removing the pin 39 and turning the bolt 35 to the appropriate position which is then locked by pin 39. As shown, the rifle 1 is cradled in the supporting member 20, and the two-point contact between the two yoke members and the butt and forearm make it unnecessary for the shooter to continuously hold or steady the rifle so that he is free to spot the game or varmint with his binoculars or to locate the targets hits with his spotting scope. At his convenience, the shooter can quickly vary the height for a sitting, kneeling or prone position by loosening the thumb screw 31 and raising or lowering the ring member 30 and then retightening the screw 31 in the new height position. When he desires to shoot, the shooter can quickly and easily angularly rotate and elevationally move the rifle to bring it on target. The present invention minimizes the human factor since the weight of the entire rifle is completely supported by the gun rest, and only the necessary force is that of pulling the trigger at the moment of firing. Thus, a high degree of accuracy is realized in varmint hunting and/or target shooting by the rifleman. After the hunting or target practice session, the rifleman simply lifts the gun 1 from the cradle 20, grasps the upper end 12 and removes the pointed end 11 from the ground and rotates the cradle 20 approximately 90° about pivot bolt 35 so that the elongated bar member 21 is in-line with the longitudinal axis of the rod 10. Thus, the gun rest is relatively compact and easy to carry and subsequently to store for future shooting sessions. The gun rest is relatively light in weight since most of the parts or components are constructed of aluminum or other lightweight material. Since the gun rest is mainly constructed of aluminum or the like, it is virtually unaffected by the adverse effects of the weather, and thus has long life and requires little, if any, repair and maintenance.

It will be appreciated that various changes, alterations and modifications may be made in the described embodiment of the present gun rest arrangement without departing from the spirit and scope of the subject invention. For example, the bolt 35 may include an additional slot to permit quarter-turn adjustments rather than half-turn adjustment as shown. Further, the dowel pin 39 may be replaced by other locking means, such as, a removable cotter pin, screw or the like. The threaded thumb screws may be replaced by suitable spring loaded retractable pins or the like. Other variations and ramifications will undoubtedly occur to those skilled in the art that are deemed to fall within the purview of the present invention which is intended to be limited only as set forth in the appended claims. Thus, it is intended and understood that the subject matter in the foregoing description and shown in the accompanying drawings should be taken and interpreted in an illustrated or diagrammatic sense only.

Having thus described the present invention, what I claim as new and desire to secure by Letters Patent is:

1. An adjustable gun support comprising, an elongated unipod having one end pointed for ground affixation, said elongated unipod member accommodating a step-on member for depressing said pointed end of said elongated unipod member into the ground, a two-point contact cradle member cooperatively associated with said elongated unipod member for steadily holding a gun in place, means for allowing said cradle member to be adjusted to various positions along the length of said elongated unipod member and spring-loaded means for allowing the gun to be unaidedly carried by said cradle member yet to be facilely rotated and pivoted for sighting-in on a target.

2. The adjustable gun support as defined in claim 1, wherein said elongated unipod member is a metallic rod.

3. The adustable gun support as defined in claim 1, wherein said cradle member includes a forward upstanding yoke member for holding the forearm portion of the gun and a rearward upstanding yoke member for holding the butt portion of the gun.

4. The adustable gun support as defined in claim 2, wherein said metallic rod includes a series of indentations located along the length thereof for providing a positive lock stop for said means which allows adjustment of said cradle member at the various positions.

5. The adjustable gun support as defined in claim 4, wherein said series of indentations provide a positive lock stop for said step-on member.

6. The adjustable gun support as defined in claim 1, wherein said step-on member is a horizontal plate which engages the surface of the ground for increasing the stabilization of the gun support.

7. The adjustable gun support as defined in claim 1, wherein said means for allowing the gun to be rotated and pivoted includes an apertured member which fits onto the elongated unipod member and an adjustable spring loaded pivot bolt which secures said cradle member to said apertured member.

8. The adjustable gun support as defined in claim 7, wherein said cradle member includes an elongated metallic body which is pivoted about a point to hold the gun in a balance position.

9. The adjustable gun support as defined in claim 7, wherein said means for allowing said cradle member to be adjusted to various positions along the length of said elongated unipod member includes a ring member and a fastener.

10. The adjustable gun support as defined in claim 3, wherein said forward and rearward upstanding yoke members include protective covering for preventing marring of the gun.

* * * * *